US005758728A

United States Patent [19]

Ragule

[11] Patent Number: 5,758,728

[45] Date of Patent: Jun. 2, 1998

[54] PLOW WITH ARTICULATING BLADE

[76] Inventor: Edward J. Ragule, 82 Rock Hill Rd., Voorheesville, N.Y. 12186

[21] Appl. No.: 880,981

[22] Filed: Jun. 23, 1997

[51] Int. Cl.[6] ..... E01H 5/00

[52] U.S. Cl. ..... 172/815; 37/281

[58] Field of Search ..... 172/815, 811, 172/810, 784, 777, 113; 37/281, 280, 104, 241

[56] References Cited

U.S. PATENT DOCUMENTS

| | | | |
|---|---|---|---|
| 3,055,126 | 9/1962 | Emhof | 172/815 X |
| 3,208,166 | 9/1965 | Proulx . | |
| 3,477,151 | 11/1969 | Zanella | 37/280 X |
| 3,651,587 | 3/1972 | Plasser et al. | 172/815 X |
| 4,077,139 | 3/1978 | Fagervold et al. | 37/280 |
| 4,208,812 | 6/1980 | Brownly | 172/784 X |
| 4,356,645 | 11/1982 | Hine et al. | 37/281 |
| 4,552,226 | 11/1985 | Platter | 172/815 |
| 4,614,048 | 9/1986 | Melby | 37/280 |
| 4,834,191 | 5/1989 | Vecchio | 172/784 |
| 4,962,600 | 10/1990 | Zellaha et al. | 37/281 X |

*Primary Examiner*—Terry Lee Melius
*Assistant Examiner*—Christopher J. Novosad
*Attorney, Agent, or Firm*—Fredric Morelle

[57] ABSTRACT

A plow blade having two oppositely pivoted/hinged sections that emulate a blade end. The sections alternately occupy a position coextensive to the blade. The sections are coupled to "gait" the movement of one with that of the other. One of the gates can only swing forward of the blade and the other can only swing rearward. When the forward (only) swinging section is thus situated, outflow off the blade is interrupted, i.e., dammed; and, as it returns to the blade coextensive position, it transfers dammed debris to the (coupled) rearward moving section for disposition into the windrow.

9 Claims, 4 Drawing Sheets

PLOW WITH ARTICULATING BLADE

BACKGROUND OF THE INVENTION

1. Field of the Invention

This invention relates generally to plowing apparatus and, in particular, to improvements in plow blades having hinged side blade devices that intermittently interrupt debris flow from off the blade and break the resultant debris ridging (or "windrow")). Unique to this invention is its departure from a single drop or gate element that performs or effects such an interruption feature.

2. Discussion of the Relevant Art

Since the advent of plowing apparatus, varying degrees of concern have been paid to the plow ejecta, that is, the debris that is pushed along and off the plow blade. However, this is of little moment if the plow's path does not cross an intersecting path or roadway and the windrow may be tolerated, depositing the debris continuously along the pathside or roadside. Where it is important to interrupt the windrow, various plow blade adjuncts have been devised. These adjuncts take the form of drops, wings or, in a small number of cases, articulated plow blades.

A wing-type snow plow device for the interruption of the windrow is disclosed in U.S. Pat. No. 4,077,139, issued to Fagervold et al. The gate attachment assembly of this patent is essentially a frame that is bracket-mounted near an end of the snow plow blade. Pivotally mounted to the frame is an arcuately movable gate that is hydraulically operated to swing between a vertical position and a horizontal position forward of the blade proper so as to acquire an angular relationship therewith and interrupt the snow windrow. A side wing, off the main blade, is used to provide the massive structure and mechanics for this very heavy duty plow apparatus. Only a fraction of the gate mechanism is exposed to windrow accumulation, the complement thereof being disposed primarily alongside the wing.

The character of drops is generally that their movement is vertical, more often than not, moving arcuately in a "chopping" fashion. The following U.S. patents are examples of such mechanisms: U.S. Pat. No. 4,208,812, issued to Brownly; U.S. Pat. No. 3,055,126, issued to Emhof; and, U.S. Pat. 3,208,166, issued to Proulx. All of the foregoing disclosures exhibit an hydraulically actuated, pivotally mounted, vertically and arcuately moving gate that effects an intermittent windrow interruption. They, like the Fagervold et al disclosure, employ but a single gate which is caused to operate in the aforesaid "chopping" fashion. Because of this operating mode, devices of all the aforementioned types have a structural disadvantage in that they must include heavy bracing or yaw control mechanisms lest the debris overburden (usually snow) unduly distress or damage the gate members' hinging or pivoting mechanisms.

The most relevant art that I found relating to the invention field is U.S. Pat. No. 4,614,048, issued to Melby. In it, Melby discloses a conventional, single bladed plow. He identifies the common problem with such plows, the fact that the ridge of snow (windrow) that is deposited during operation often burdens intersections, driveways and crosswalks. To obviate the problem, by intermittently interrupting the flow of snow from along and off the blade, the Melby patent uses an articulated blade end (gate) that is hydraulically movable on a hinge assembly from a first position, coextensive with the blade, to a second position forward of the blade and forming an obtuse angle therewith. There are two noticeable deficiencies in this otherwise highly utilitarian plow design. First, the oblique angle formed between the gate and blade is not as efficient a dam as would one be that formed a right or acute angle. This datum is formed from my more than 20 years experience working with and studying plowing assemblies. Second, when the Melby gate is in the second or forward position, the extreme blade end no longer has the scraping length as it had when the gate was in the first position; thus, a strip of snow between the now forwardly disposed gate edge and the curb reference is left unplowed. I found it incumbent on me to provide an improvement that would eliminate these liabilities.

3. Incorporation by Reference

The Melby patent, U.S. Pat. No. 4,614,048 discloses an articulated blade end, with hinging and hydraulic mechanisms that are relevant to my invention. Also, terminology used therein is consistent with that used by me in this application. Finally, the claims quite well define the bounds of his art and the state-of-the-art from which I depart significantly hereinafter. For these reasons, U.S. Pat. No. 4,614,048, issued to Melby for SNOW PLOW BLADE WITH HINGED SIDE BLADE, is hereby incorporated by reference.

4. Definitions

Peculiar to the instant disclosure, the following terms shall have the indicated meanings:

blade means the primary scraping element of a plow;

coupling means any form of linking or connecting means;

dam n.(v.) means the article(the action) that interrupts windrow formation;

gait means a matched pace or movement;

gate means an article that swings on a hinge or pivot;

ridge means a windrow, as previously defined; and windrow means that continuous pile of snow or debris that trails from off a plow blade.

SUMMARY OF THE INVENTION

I have overcome the limitations and deficiencies of the prior art by devising a plow blade, an end of which consists of two oppositely hinged (or pivoted) gates, each of which operationally emulates the blade. The first of these gates is pivotally movable from a first position, that trails behind the plow blade, to a second position that is coextensive with the blade. Linked or coupled with the first gate is a second pivotally movable gate that is mounted to the extreme end of the blade-frame structure and effects a first posture similar to the second position of the first gate, that is, coextensive with the blade; it is precluded, by a link/coupling scheme from simultaneously occupying the blade-coextensive position with the first gate. This scheme includes the "gaiting" operation of the invention that compels the second gate to assume a second position with its unrestrained (non-pivoted) end forward of the blade and assuming a right angle, or less, with the blade. In its second position, the second gate forms a dam in the flow of the debris/snow along the plow blade and interrupts the windrow. In the preferred and simplest embodiment, hydraulics are employed to actuate one of the gates, while a mechanical link or coupling is used to "gait" the other to its motion. Thus, with gaited movement, the gates move to alternately occupy the blade coextensive position while intermittently effecting a dam and accomplishing the windrow interruption feature.

DETAILED DESCRIPTION OF THE PREFERRED EMBODIMENT

Snow plowing is often done using a conventional scraping blade that is frame-mounted to a utility vehicle such as a tractor, a back-hoe or a pickup truck. The frame may consist in a separate blade frame that is fixed to a vehicle mounting apparatus (also colloquially termed a "frame" or "superstructure") or simply a blade bolted to an assembly of pusher bars. Irrespective of the aforementioned apparata, my invention will work on, or be readily conformed to work on, almost any type of plow blade that is used today. Although I will present it with respect to a relatively small (scraping) blade that is rigged for use with a pickup truck, it should be understood that this improvement to the art, and especially the disclosure of a novel, gaited twin-gate apparatus, is applicable to plows used throughout modern industry. With this spirit of application in mind, I will now explain the salient features of my invention.

Figure 1:
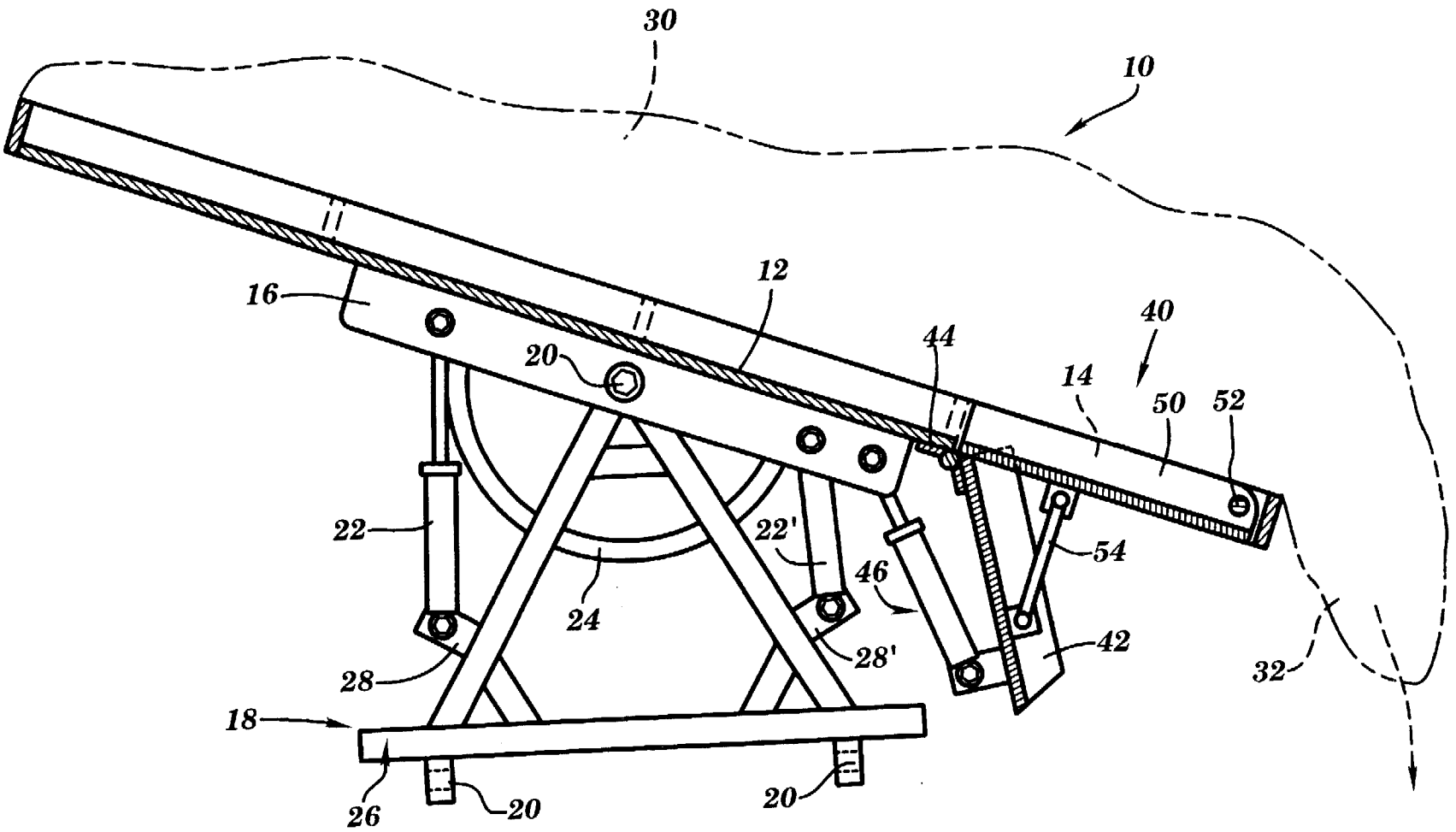
FIG. 1 is a plan view of the invention.

Having reference to FIG. 1, a plan view of the assembled invention 10 illustrates a conventional plow blade 12, the right portion periphery forming a rigid frame 14. This blade-frame 14 is used to provide support for one of the gates of the invention and will be more clearly defined in FIG. 4. A blade mount 16 is attached to the backside of the blade 12 and serves as the blade reference plane for pitch and yaw control of the blade. Vehicle mounting apparatus 18, often termed the "push frame" is used to rig the plowing assembly to a vehicle (not shown). A blade mount pivot 20 facilitates an attachment of the blade mount 16 to the apex of the mounting apparatus 18. The mounting apparatus 18 is then set to the vehicle by fixtures 20; here, those of the boltable type are shown. The latter are favored because they serve as a fulcrum for the blade lifting/lowering lever system (conventional and not shown). In this superstructure, of my design, I use the D-ring 24, or pitch stabilizer, to control the "dipping" or pitch of the blade mount 16. It is fixed at the ends of the (partial) ring to the blade mount proper and is allowed to slew under (or through) the mounting apparatus 18. At the rear of the superstructure or vehicle mounting apparatus is the base bar 26 or bracket from which the bolting fixtures 20 project rearward. Projecting from and forward of the base bar 26 are the left and right hydraulic support brackets (28' and 28', respectively). Connecting the ends of these support brackets (28,28') to the blade mount 16 are hydraulic yaw controls (22,22', respectively). Thus, the reader sees how the blade mount 16, and the blade 12, can undergo the full panoply of plow operations save the function of (intermittently) interrupting the cast-off debris/snow 30 from forming a continuous plow ridge or windrow 32.

Attention is now drawn to the rightmost portion 40 of FIG. 1. The first prominent feature is the rearward gate 42. This is a separate portion, an end, of the blade 12 that is hingedly attached to the blade 12 by hinges 44 and is designed to swing thereon in a clockwise (CW) movement to the rear. A gate actuator assembly 46 hydraulically couples the rearward or rear gate 42 to the blade mount 16 or other blade-reference base. At the extreme side of the blade frame 14, another segment of the blade end, forward or front gate 50 is pivot(ally) 52 mounted and designed to swing thereon CW to the fore of the blade 12. Physically coupling the two gates is a link(ing) arm 54 that is pivotally mounted, at each end thereof, to the front of the rear gate 42 and to the rear of the front gate 50. This coupling or linking compels the two gates 42, 50 to always rotate in different rotational (CW/CCW;CCW/Cw) directions with respect to their pivotal points, but remain gaited (both swinging forward; both swinging rearward) when moving with respect to the blade direction. This novel articulated dual gate system is thus shown in the normal plowing mode (with windrow 32) formation.

Figure 2:
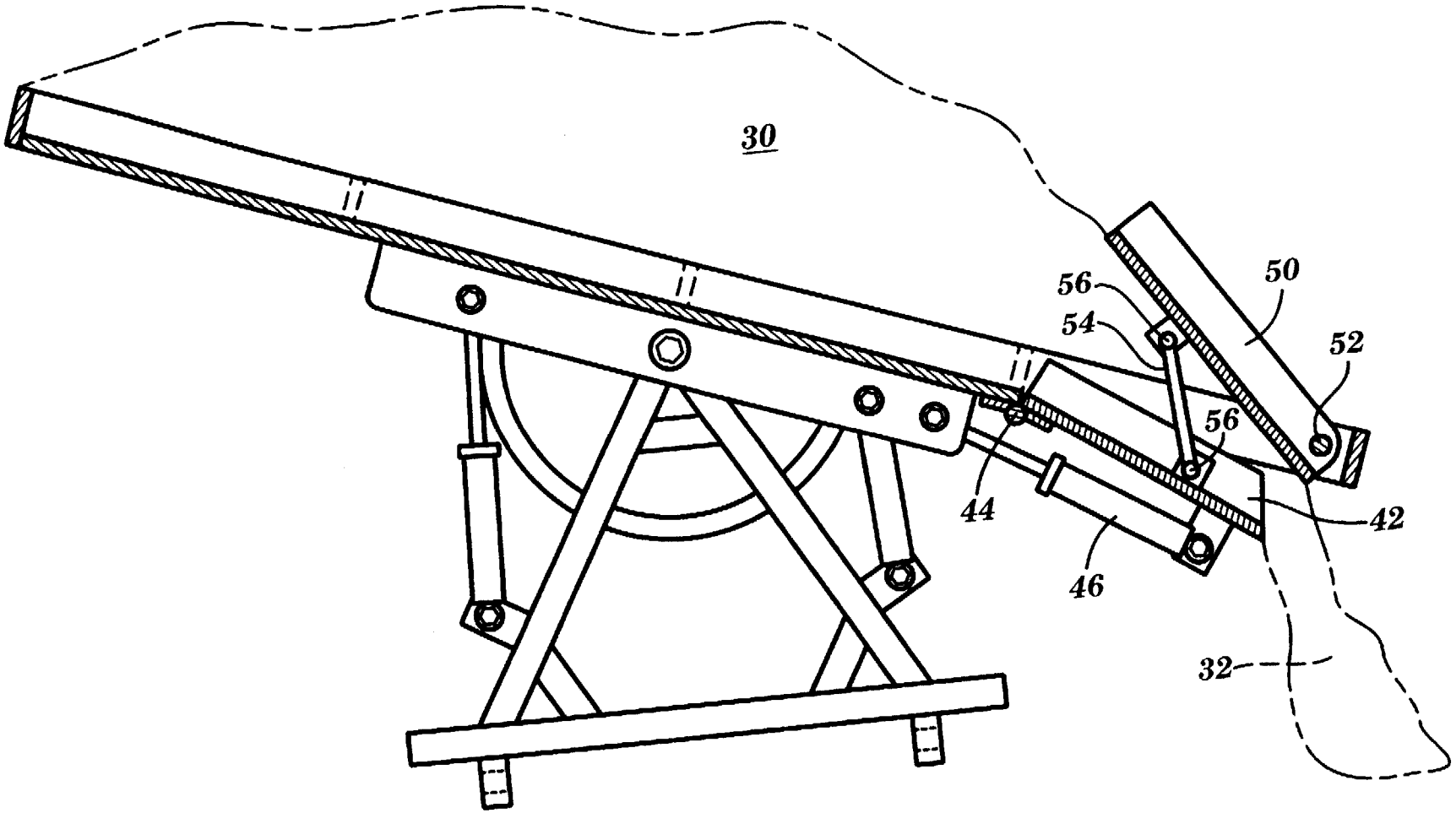
FIG. 2 is a plan view similar to FIG. 1 with both gates in coupled, intermediate positions.
Figure 3:
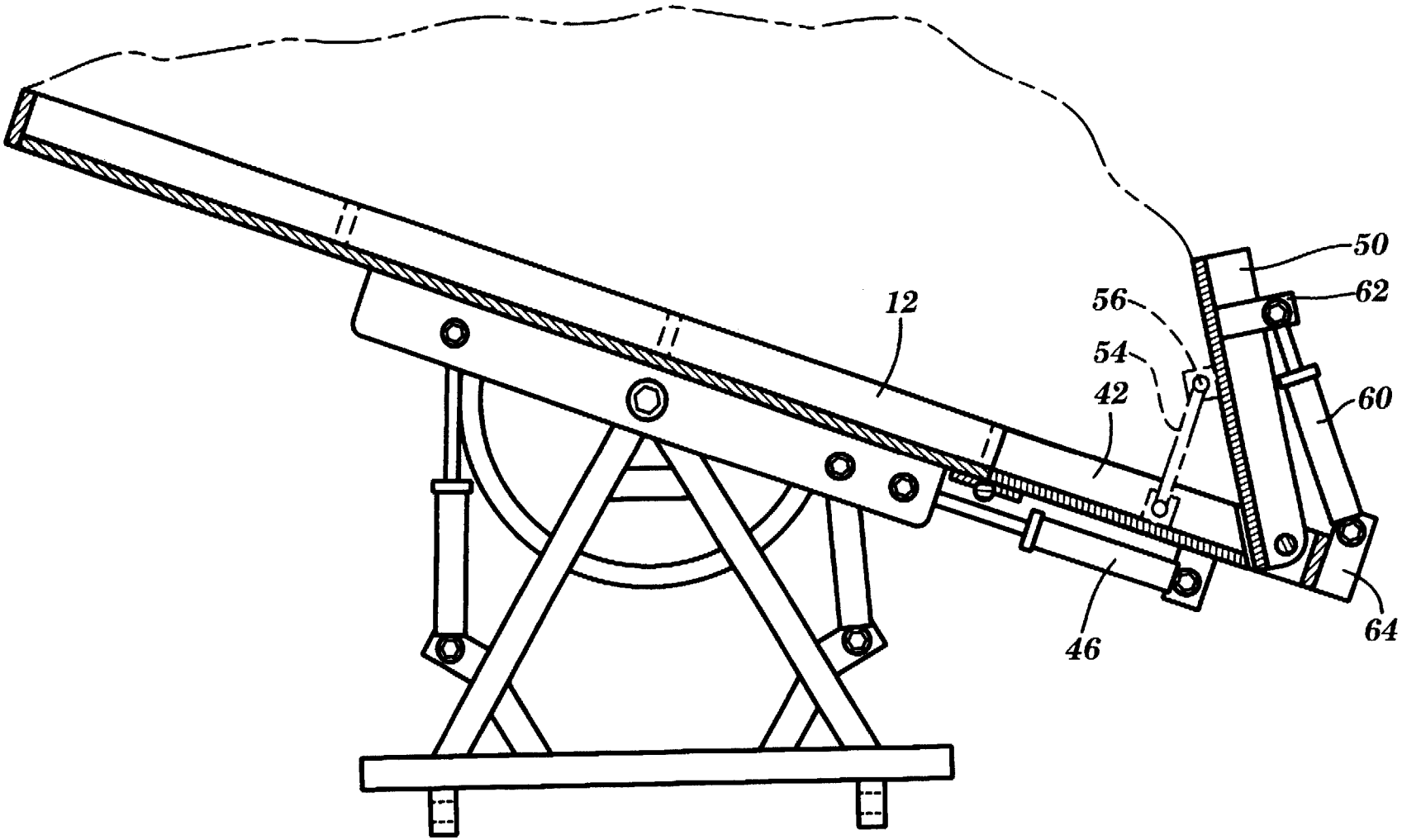
FIG. 3 is a plan view of the invention with the interruption feature operating and disclosing alternate gate motivation.
Figure 4:
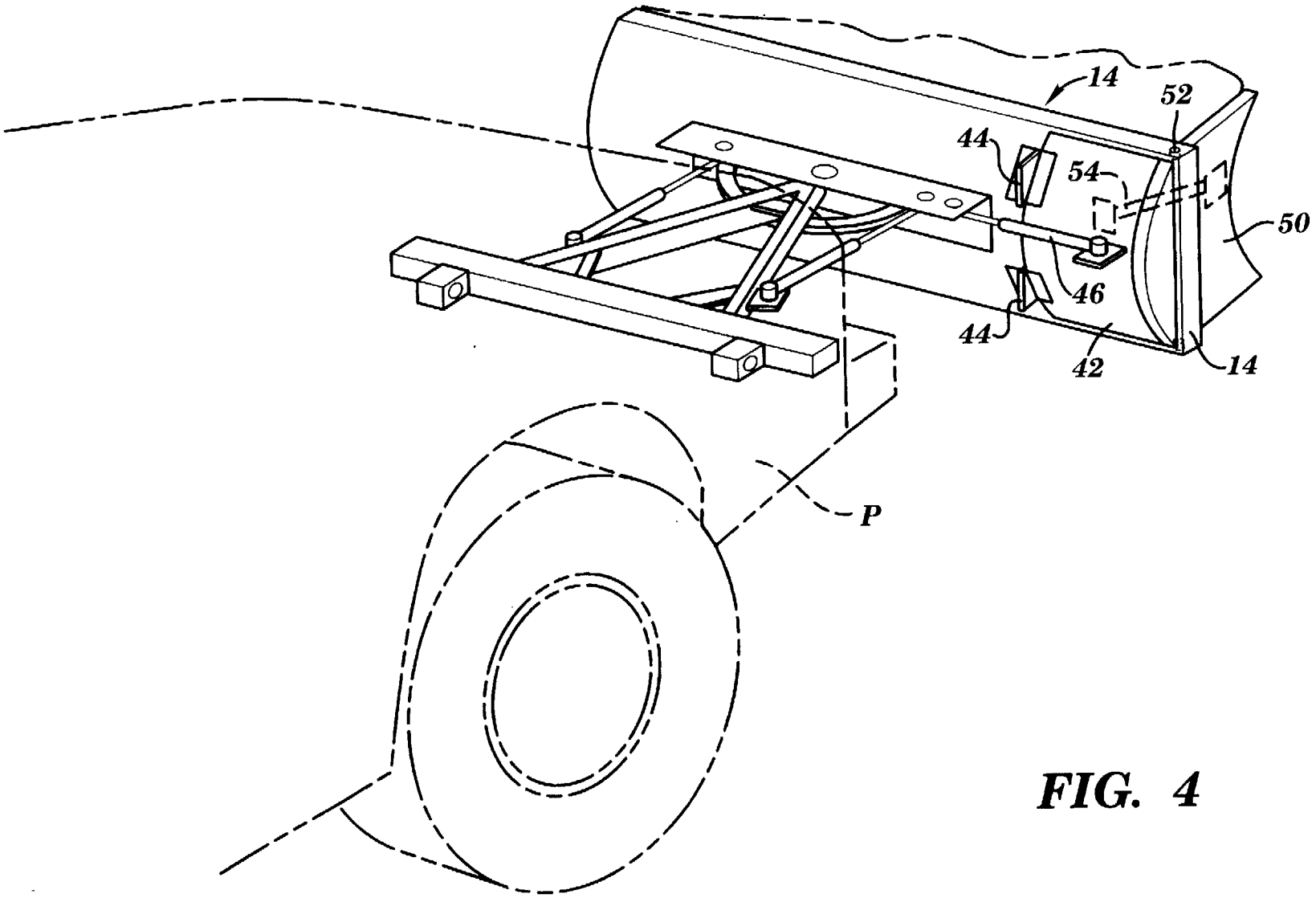
FIG. 4 is an isometric illustration of the invention.

Turning to FIG. 2, the reader sees the same apparatus shown in FIG. 1, except that now the two gates are portrayed in a dynamic mode. I have chosen to portray my invention in its least complicated form, by using a singular gate link 54 to gait forward gate 50 motion to that of rear gate 42. Here the arm or link 54 is pivotally 56 attached to the forward gate and to the front side of the rear gate. The latter is motivated by the gate assembly actuator 46. It should be understood that this mechanization is an expedient and that the other forms of gate dynamic coupling may be used in lieu of the physical link, e.g., hydraulic coupling, or by electrical devices, etc. A glance at FIG. 3, a plan view of the forward gate fully extended, depicts an additional or second hydraulic cylinder 60 that is bracket/pivotally 62 mounted to the forward gate 50 front surface and pivotally 64 attached to the blade frame 14 (see FIG. 4 for full frame 14 view). In this alternate embodiment, the link 54 would be dispensed with and the hydraulic control system (conventional; not shown) would provide the gaiting and coupling function. As mentioned, and in similar fashion, electrical devices could be substituted, with the appropriate electrical control system, for the disclosed hydraulics. FIG. 4 provides the reader with an isometric, rear-quartering view of a pickup-type pusher vehicle F to which is mounted the preferred embodiment of my invention as disclosed in FIGS. 1 and 2. As referred to in FIGS. 1 and 3, but not shown, the blade frame 14 is clearly identified; and, it is to this frame that the forward gate 50 is pivot(ally) 52 mounted.

Absence of minor details, or irrelevant omissions from the drawings, notwithstanding, I have provided the best mode for realizing my invention. Those skilled in this field may, after use of the invention, provide reasonable variations and modifications without departing from the spirit of the invention. Such are to be welcomed, consistent with the hereinafter appended claims.

What is claimed is:

1. An improvement to a plowing apparatus having an articulable blade gate mechanism that is connected to a main blade thereof, said improvement comprising:

a first gate member that is hinged to said main blade and capable of a swinging movement rearward of the main blade and forward into a coextensive relationship therewith;

a drive means for urging said movement of said first gate member;

a second gate member pivotally mounted to a frame portion of said main blade and movable between a first position in a coextensive relationship with the main blade and a second position in an angular relationship therewith; and a linking means for assuring that when the first gate member is moved rearward, the second gate member is moved to said first position and as the first gate member is moved forward, the second gate member is moved forward and urged into said second position.

2. The improvement of claim 1 wherein said drive means is at least one hydraulic actuator.

3. The improvement of claim 1 wherein said linking means is a rigid shaft pivotally fixed at one end to the first gate member and pivotally fixed at the other end to the second gate member.

4. A dual gate assembly attached to a plow blade for intermittent interruption of debris flow that is discharged during a plowing operation comprising:

a first gate hinged to an end of the plow blade for swinging movement from a position coextensive with the blade towards a direction rearward of the blade;

a second gate pivotally mounted to a frame portion of the plow blade, proximate an extreme of the blades for swinging movement from said position coextensive with the blade towards a direction forward of said blade;

a link member pivotally coupled to a rearward side of the second gate and pivotally coupled to the first gate so that said first gate and said second gate alternately and exclusively occupy the position coextensive with the blade; and power means for driving at least one of said first and said second gates to acquire said intermittent interruption.

5. The assembly of claim 4 wherein said first gate and said second gate are morphalogically conformable to the plow blade.

6. The assembly of claim 4 wherein said power means is at least one hydraulic device.

7. A plow mechanism including a main blade and comprising a blade end that is hingedly mounted to, and which swings rearward of, the main blade, said blade end having disposed thereon means for coupling it to a gate member that is pivotally mounted to a main blade frame portion, extensive of the main blades so that said gate follows and precedes movements of said blade end as it swings rearwardly and forwardly, respectively.

8. The mechanism of claim 7 further comprising a pivotal linking member for operatively coupling the gate member and the blade end.

9. The mechanism of claim 7 further comprising at least one hydraulic device for driving the gate member and the blade end.

* * * * *